US005338438A

United States Patent [19]

Demoulin et al.

[11] Patent Number: 5,338,438

[45] Date of Patent: Aug. 16, 1994

[54] PROCESS AND APPARATUS FOR THE HOMOGENIZATION OF THE MIXTURE OF SOLID PARTICLES AND HYDROCARBON VAPORS BEING TREATED IN A FLUIDIZED BED WITHIN A TUBULAR REACTOR FOR THE CRACKING OF HYDROCARBONS

[75] Inventors: Vincent Demoulin, Paris; Marc Fersing, Saint Adresse; Thierry Patureaux, Montivilliers; Denis Pontvianne, Montrouge, all of France

[73] Assignee: Total Raffinage Distribution S.A., Levallois Perret, France

[21] Appl. No.: 788,216

[22] Filed: Nov. 5, 1991

[30] Foreign Application Priority Data

Nov. 8, 1990 [FR] France ..... 90-13874

[51] Int. Cl.[5] ..... C10G 11/18

[52] U.S. Cl. ..... 208/153; 208/127; 208/164

[58] Field of Search ..... 208/153, 164, 127

[56] References Cited

U.S. PATENT DOCUMENTS

| | | | |
|---|---|---|---|
| 2,901,420 | 8/1959 | Evans | 208/153 |
| 2,906,695 | 9/1959 | Boston | 208/161 |
| 4,036,779 | 7/1977 | Schatz et al. | 208/164 |
| 4,479,870 | 10/1984 | Hammershaimb | 208/153 |
| 4,534,851 | 8/1985 | Allan et al. | 208/153 |
| 4,615,992 | 10/1986 | Murphy | 208/164 |
| 4,753,780 | 6/1988 | Bowen | 208/158 |
| 4,883,583 | 11/1989 | Mauleon et al. | 208/113 |
| 4,994,424 | 2/1991 | Leib et al. | 208/164 |

FOREIGN PATENT DOCUMENTS

| | | | |
|---|---|---|---|
| 0369536 | 5/1990 | European Pat. Off. | C10G 11/18 |

*Primary Examiner*—Helane Myers

*Attorney, Agent, or Firm*—A. Thomas S. Safford

[57] ABSTRACT

A process for the substantial homogenization of the mixture of hot solid particles and of the hydrocarbon vapors to be treated within a tubular reactor (preferably an FCC unit) for the cracking of hydrocarbons in a fluidized bed of hot solid particles. Directly downstream of the zone of injection, in the reaction zone of the feedstock to be or being treated, usually where at least 75 percent of the droplets of the feedstock are vaporized, there is injected into the reactor a fluid in the gaseous state at one or more points on the interior surface of the side wall of the reactor.

15 Claims, 3 Drawing Sheets

PROCESS AND APPARATUS FOR THE HOMOGENIZATION OF THE MIXTURE OF SOLID PARTICLES AND HYDROCARBON VAPORS BEING TREATED IN A FLUIDIZED BED WITHIN A TUBULAR REACTOR FOR THE CRACKING OF HYDROCARBONS

RELATED APPLICATIONS

This application claims the benefits of priority under 35 U.S.C. § 119 from French application No. 90 13874, filed Nov. 8, 1990, which is hereby incorporated herein by reference.

FIELD OF THE INVENTION

The present invention relates to a process and an apparatus for substantial homogenization of a mixture of solid particles and of hydrocarbon vapors to be treated in a fluidized bed of solid particles in a tubular reactor for the cracking of hydrocarbons. More particularly, the invention relates to a process and an apparatus of this type applicable to the catalytic cracking in the fluid state of hydrocarbon feedstocks in a substantially upright tubular reactor operating with an upflow or downflow fluidized bed.

BACKGROUND OF THE INVENTION

It is known that the petroleum industry routinely employs hydrocarbon conversion processes, and particularly cracking processes, in which hydrocarbon molecules having a high molecular weight and a high boiling point are broken down into smaller molecules having a lower boiling point which are suitable for use.

Many of these processes make use of fluidized-bed conversion techniques. In these fluidized bed techniques, solid particles supply the heat necessary for the conversion reaction. The particles are contacted with hydrocarbons for a very short time. The particles can be catalytic.

The process most widely employed at present is the so-called Fluid Catalytic Cracking, or FCC, process. However, other fluidized-bed conversion processes, such as thermal cracking or visbreaking processes, have also been developed.

For the sake of simplicity, the description which follows will be confined to the presentation of the invention within the framework of the catalytic cracking process, it being understood that the invention is applicable to most fluidized-bed hydrocarbon conversion processes in which the feedstock to be cracked is contacted in the vapor phase with solid particles, whether catalytic or not.

Among the most important parameters which determine the efficiency of a cracking reaction are the rapidity with which the feedstock to be treated is contacted with the hot catalyst particles and the homogeneity of distribution of these catalyst particles in the fluidized bed throughout the reaction zone.

The research conducted by Applicants' Assignee with a view to improving the heat transfer between the solid particles in the fluidized bed and the feedstock to be treated has shown that the yields actually obtained in the highest-efficiency cracking units in use up to now are below those to be expected on the basis of theoretical studies, and that this shortfall is due in particular to poor distribution of the catalyst particles in the reaction zone, and especially in the zone where the feedstock to be treated is injected.

In its French and U.S. patent applications, French Nos. 2,585,030, and 89 14787 (and the equivalent U.S. Ser. No. 07/612,322, filed Nov. 13, 1990 pending, incorporated herein by reference), Applicants and the Applicants' Assignee have already proposed means designed to remedy, within the reactor, the axial irregularities in the flow of hot catalyst coming from the regeneration zone and to provide for improved fluidization of the solid catalyst particles upstream of the zone where the hydrocarbons are injected.

However, even when the flow of catalyst is regularized so as to render it as homogeneous as possible upstream of the injection zone of the feedstock to be treated, it has been found that downstream of that zone the distribution of the catalyst particles again becomes heterogeneous, the density of distribution of these particles being higher in the vicinity of the walls of the reactor than in its center.

This natural tendency of the catalyst and the gas phase to segregate due to the interaction between the catalyst and the wall is intensified by the sudden vaporization of the feedstock, which tends to throw the catalyst toward the wall of the reactor, thus producing a concentration of catalyst in the vicinity of the reactor wall. A portion of the catalyst then advances only slowly or even tends to swirl in a direction counter to the motion of the feedstock (an effect known in the art as backmixing) in both an upflow and downflow fluidized beds.

The work carried out by the Applicants and their Assignee have shown that the spread observed between the theoretical yields and those actually obtained are also due in part to this poor distribution of the particles in the reaction zone after injection of the feedstock. This unequal distribution is attributable to the vortices produced by the combined effect of the sudden vaporization of the feedstock and of the high speed of injection thereof, as well as to the chafing of the catalyst particles against the walls. The result is what is known to those skilled in the art as backmixing, which also accounts for the fact that at the periphery of the reactor the catalyst particles are only slightly fluidized, if at all. Consequently, the particles, preferentially disposed at the periphery of the reactor, may stagnate or even flow back along the wall. As a result, the temperature distribution is not uniform throughout the section of the reaction zone downstream of the feedstock injectors. The temperature is excessively high at the periphery of the reactor since the particle density is too high near the walls. These excessively high temperatures cause the feedstock to be overcracked, interfere with the desired liquid conversion; and thus, promote the production of dry gases. Conversely, when the atomized feedstock comes into contact with a stream of catalyst particles that is not dense enough in the central part of the reactor, the quantity of heat supplied by these particles is not sufficient to raise the temperature of the feedstock to the level necessary for the desired reactions to take place; and thus, substantial coking of the catalyst occurs which leads to its deactivation.

OBJECTS OF THE INVENTION

The present invention seeks to remedy the drawbacks of prior art fluidized beds by providing means for a homogeneous distribution of the hot solid particles, and more particularly of the catalyst particles, in an upflow or downflow fluidized-bed hydrocarbon cracking reactor. These means are preferably downstream of the zone of injection into the reactor of the hydrocarbon feedstock to be treated.

The invention further seeks to render the contact between the hot catalyst particles and the hydrocarbon vapors uniform throughout the reaction zone of such a fluidized-bed cracking reactor.

Finally, the invention seeks to render the velocity of the fluids uniform and to prevent any backmixing downstream of the zone of injection of the hydrocarbon feedstock to be cracked in such a hydrocarbon cracking reactor.

SUMMARY OF THE INVENTION

To this end, the present invention provides a process for the homogenization of a mixture of solid particles and of hydrocarbon vapors to be treated in a fluidized bed of hot solid particles within a tubular reactor for the cracking of hydrocarbons. In the process a stream of hot solid particles is preferably continuously fed to the tubular reactor, which is preferably disposed substantially upright; an upward or downward motion is imparted to these particles within the reactor while they are maintained in a dilute fluidized bed; at least one hydrocarbon feedstock to be cracked is brought into contact with these particles by injecting said feedstock into the dilute fluidized bed within the reactor; the gas phase resulting from the contacting of the hydrocarbons with these particles is separated from the latter; the gas phase and the particles so separated are recovered; these particles are optionally treated so as to reactivate them; and then they are recycled to the inlet of the reactor.

The inventive process especially comprises injecting into a tubular reactor for the cracking of a feedstock of hydrocarbons a fluid in the gaseous state. The injecting is preferably in a reaction zone comprising a fluidized bed of hot solid particles and is preferably downstream, more preferably directly downstream, of a zone of injection of the feedstock. The injecting is accomplished more preferably with at least 75 percent of the feedstock being vaporized. To accomplish this, the feedstock is usually vaporized from very fine droplets.

The fluid in the gaseous state is preferably injected into the reactor at a plurality of points evenly distributed over the interior surface of the reactor. These injection points can be distributed either annularly or helically.

This fluid in the gaseous state may be injected into the reactor in a plane which makes an angle of from about 30 to about 150 degrees with the axis of the reactor. The gaseous fluid may also be introduced into the reactor substantially tangentially to the reactor side wall.

The injection of the gaseous fluid directly downstream of the zone of injection of the hydrocarbon feedstock has the effect of causing the particles previously forced against the interior surfaces of the reactor walls by the sudden vaporization of the feedstock to flow back toward the center of the reactor. This results in a more homogeneous distribution of the hot solid particles in the reaction zone of the reactor located downstream of the injection zone of the hydrocarbon feedstock or feedstocks; and consequently in an improved conversion to liquid products from the hydrocarbons to be or being cracked. The improved conversion is accompanied by less deposition of coke on the solid particles and reduced production of dry gases.

The fluid in the gaseous state may be hydrogen, an inert gas such as nitrogen, argon and the like, a light hydrocarbon, for instance a hydrocarbon having from 1 to about 5 carbon atoms, such as methane, ethane, propane, butane or pentane, a vaporized gasoline, or also, and preferably, steam.

The throughput of injected fluid may represent from about 0.005 to about 1 percent by weight of the throughput of solid particles in circulation. The velocity of the fluid in the gaseous state at the outlet of the device injecting that fluid will generally range from about 1 to about 100 meters/second, and preferably from about 20 to about 50 m/s.

The pressure of injection of the fluid in the gaseous state will of course depend on the velocity of injection and on the operating conditions of the reactor.

The temperature of injection of the fluid does not have a significant effect on the temperature profile of the particles downstream of the zone of injection of the feedstock because of the low throughput of injected fluid in relation to the catalytic mass of the circulating fluidized bed.

The invention further provides an apparatus for the substantial homogenization of the mixture of solid particles and of the hydrocarbon vapors to be treated in a fluidized bed of hot solid particles within a tubular reactor for the cracking of hydrocarbons.

The reactor is preferably disposed substantially upright and comprises means for the continuous feeding of a stream of hot solid particles; means for imparting to the particles within the reactor an upward or downward motion while maintaining them in a dilute fluidized bed; means for injection within the reactor into the dilute fluidized bed of at least one hydrocarbon feedstock; means for separating the gas phase resulting from the contacting of the hydrocarbons with said particles; means for the separation and the recovery of the gas phase and of the solid particles; optionally means for the treatment of the recovered particles for the purpose of the reaction; and means for recycling the particles to the inlet of the reactor.

The inventive apparatus especially comprises a means for injection of a fluid in the gaseous state into a tubular reactor for cracking a hydrocarbon feedstock in a fluidized bed of hot solid particles; said reactor having a side wall and the side wall having an interior surface; said means being positioned downstream, preferably directly downstream, of a zone of injection of the hydrocarbon feedstock, and, at one or more points on the interior surface of the side wall of the reactor.

In the apparatus of the invention, the means for injection of the fluid in the gaseous state are preferably located downstream from the feedstock injectors and at a distance therefrom of about 0.5 to about 6 times the radius of the reactor.

In one embodiment of the invention, the injection means for the fluid in the gaseous state may comprise a chamber connected to a source of pressurized gas, said chamber opening into the reactor through at least one orifice. Preferably several chambers are provided and open into the reactor through a plurality of orifices preferably distributed evenly, for example in an annular or helical manner, relative to the axis of the reactor. These orifices are preferably in the form of slots.

In another embodiment of the invention, the means for injection of the gaseous fluid into the reactor may comprise at least one injector connected to a source of pressurized gas. The injection provides a jet of gaseous fluid into the reactor. The injector can be connected to a header which is in turn connected to the source of pressurized gas such that the injector is connected to the source of pressurized gas through the header. The axis of the injector preferably being substantially tangential to the interior surface of the side wall of the reactor. The reactor preferably has several injectors, preferably distributed evenly about its axis, and connected to a header. The header is supplied from the source of pressurized gas. In this embodiment, since the jets of gaseous fluid are introduced tangentially by the injectors, the solid particles near the interior surface of the wall of the reactor are caused to flow away from the surface of the wall, into the interior or center of the reactor, in a circular or helical movement or rotation.

BRIEF DESCRIPTION OF THE DRAWINGS

In this specification and in the accompanying drawings, we have shown and described preferred embodiments of the invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

In the drawings.

DETAILED DESCRIPTION

Figure 1:
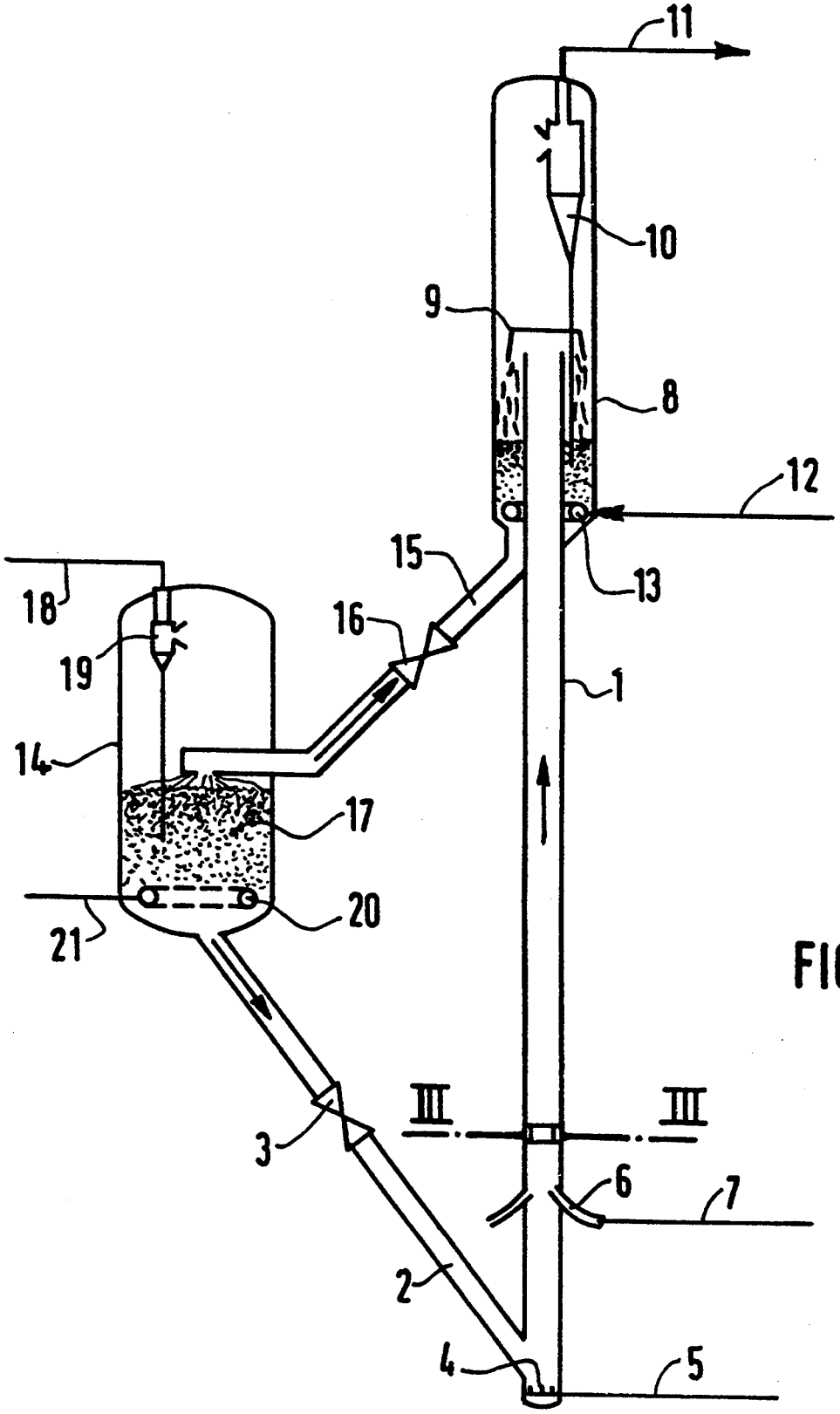
FIG. 1 is a diagrammatic view of an installation for the catalytic cracking of hydrocarbons which uses a dilute upflow of catalyst and is equipped with a first preferred embodiment of the homogenization apparatus of the invention.
Figure 2:
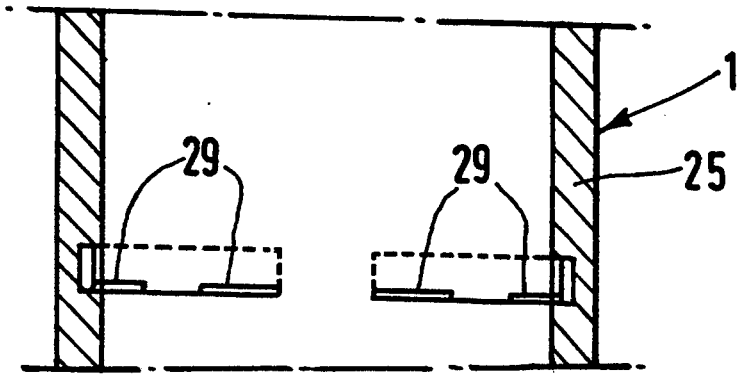
FIG. 2 is a view of a detail of FIG. 1 in the vicinity of section line III—III on an enlarged scale.
Figure 3:
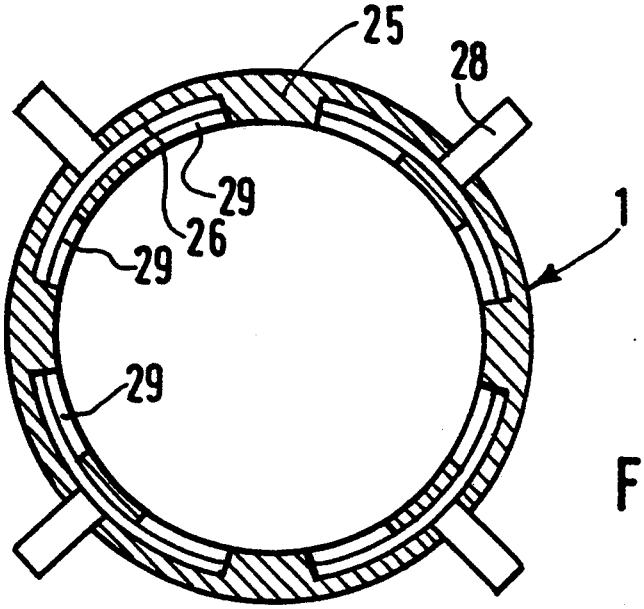
FIG. 3 is a cross-section along the line III—III in FIG. 1.

Reference will now first be made to FIGS. 1 to 3, wherein a typical unit for catalytic cracking in the fluid state, but equipped with an embodiment of the invention, is depicted. In this unit the regenerated catalyst is introduced at the base of the tubular reactor 1 through a line 2 at a rate determined by the degree to which a valve 3 is opened or closed. The catalyst particles are then propelled toward the top of the reactor by the injection at its base of a gaseous fluid coming from a line 5, this injection being effected by means of a fluid distributor or diffuser 4. The feedstock to be cracked is introduced at a higher level through a line 7 by means of devices 6 for its appropriate atomization into the stream of catalyst particles.

The reactor 1 discharges at its top into an enclosure 8, which here is concentric therewith and in which the gaseous effluents are separated from the catalyst particles by means of a ballistic separator 9 and the deactivated catalyst particles are stripped. The reaction products are separated from any catalyst in a cyclone system 10 which is accommodated in the upper portion of the enclosure 8 and at the top of which a line 11 is provided for discharging the reaction effluents to the outside. The deactivated catalyst particles drop to the bottom of the enclosure 8, where a diffuser 13 supplies the fluidized bed with stripping gas (usually steam) from a line 12. The deactivated catalyst particles so stripped pass to a regenerator 14 through a pipe 15 provided with a control valve 16.

The regenerator 14 here comprises a single regeneration chamber where the deactivated catalyst particles are introduced into the upper portion of the fluidized bed 17 while the flue gases are discharged through a line 18 after having passed through a cyclone 19.

The catalyst particles are regenerated or reactivated, in a fluidized bed, by combustion of the coke and of the hydrocarbons still present on their surface or in their pores, through an injection of air or of oxygen by means of a diffuser 20, supplied from a line 21. The catalyst particles, brought to a high temperature by the heat of combustion, pass back to the base of the reactor 1 through a line 2.

As pointed out above, the hydrocarbon feedstock injected at 6, usually preheated to a temperature of from about 150° to about 400° C., is vaporized virtually instantaneously on contact with the catalyst particles, whose temperature ranges from about 600° to about 900° C. This sudden vaporization has the effect of throwing the catalyst particles toward the side wall of the reactor 1, which results in an uneven distribution of the catalyst particles downstream of the zone of injection of the hydrocarbon feedstock posing a risk of back-mixing in the vicinity of the interior surface of the wall 25 of the reactor 1.

To overcome this drawback, a gas stream adapted to force the catalyst particles toward the axis of the reactor is, in accordance with the invention, injected into the reactor directly downstream of the devices 6 for atomization of the hydrocarbon feedstock.

In this embodiment of the invention, four chambers 26, distributed evenly about the axis of the reactor 1, are positioned within the thickness of the wall 25 of the reactor 1. These chambers 26 are connected through pipes 28 to a source of pressurized gas. The chambers 26 each discharge into the interior of the reactor 1 through two slots 29 which are orifices in the wall 25 (through the interior surface thereof). The eight slots 29 are distributed in an annular manner evenly about the axis of the reactor 1.

The jets of gas injected through the slots 29 are directed perpendicularly to the wall 25 toward the interior of the reactor 1, thus preventing the catalyst particles from accumulating in the vicinity of the wall 25, and providing for better contact between the hydrocarbon vapors and the catalyst particles.

The gas used may advantageously be steam of a temperature on the order of about 350° C. and an effective pressure of about 18 bars.

Figure 4:
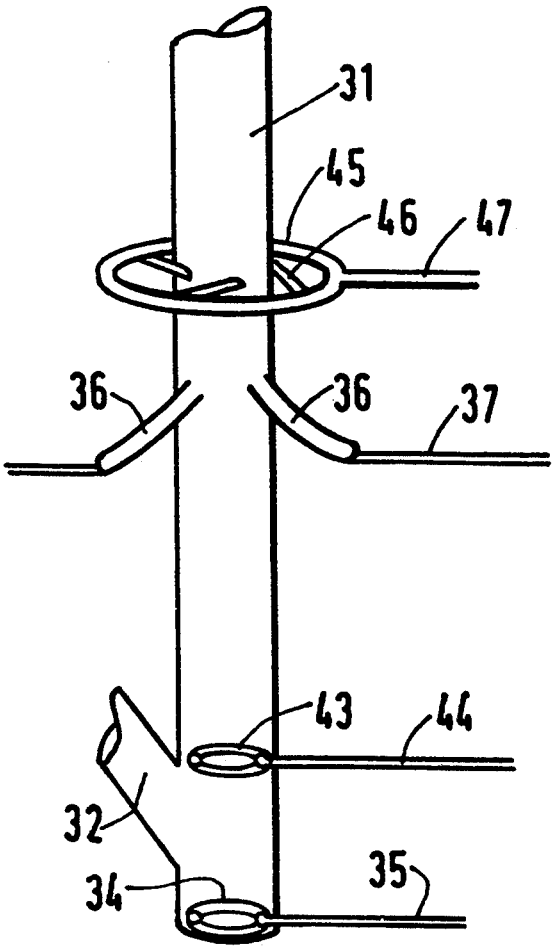
FIG. 4 is a partial diagrammatic view of a dilute-upflow catalytic cracking reactor equipped with a second preferred embodiment of the homogenization apparatus of the invention.

Turning now to FIG. 4 which shows an embodiment wherein the reactor 31 comprises two systems for fluidization of the regenerated catalyst particles recycled to the reactor through the line 32. A first diffuser 34, supplied through the line 35, injects at the base of the reactor 31, below the junction of line 32 and the reactor, a sufficient quantity of fluid to maintain a dense fluidization assuring the homogenization of the particles in this zone. A second diffuser 43, supplied through the line 44 and located downstream of the junction of line 32 and the reactor, then permits injection of a quantity of fluid necessary for creating the conditions of dilute fluidization, with a constant throughput of particles, which then flow upward in the reactor with an axial velocity preferably exceeding about 1.5 meters/second and more preferably ranging from about 2 to about 10 m/s. Reactor 31 is further equipped with injector(s) 36 which is supplied by line 37. Injector(s) 36 is for the introduction and atomization of the hydrocarbon feedstock into reactor 31. See, for example, U.S. Pat. No. 4,832,825, issued May 23, 1989. The improved homogenization derived from the use of the second diffuser 43 is partially disrupted by the effect of injector(s) 36 and subsequent feedstock vaporization.

In accordance with the illustrated, preferred embodiment of the invention, there is provided in the zone located directly downstream of the injector(s) 36 a gaseous fluid injection device which comprises injection tubes 46, fluid distributor 45 and line 47. Injection from the device (45, 46, 47) is preferably tangentially to the wall of the reactor, preferably at four points located symmetrically in a plane normal to the axis of the reactor.

Each of the injection tubes 46 is connected to the fluid distributor 45 which is supplied through line 47. The tangential injections are effected simultaneously at several points of the reactor and thus permit the fluidized phase situated in the vicinity of the wall of the reactor 31 to be set into rotation at a rotative speed that is directly proportional to the quantity of fluid injected. The gaseous fluid is preferably of the same type as that used for fluidization of the catalyst particles.

The angle between the injectors and the plane normal to the axis of symmetry of the reactor is preferably small so that the quantity of fluid to be injected to obtain the required rotation is kept to a minimum. Moreover, it is preferred that these injectors follow as closely as possible, the axial symmetry of the reactor in order to obtain good homogeneity of the fluidized bed.

Figure 6:
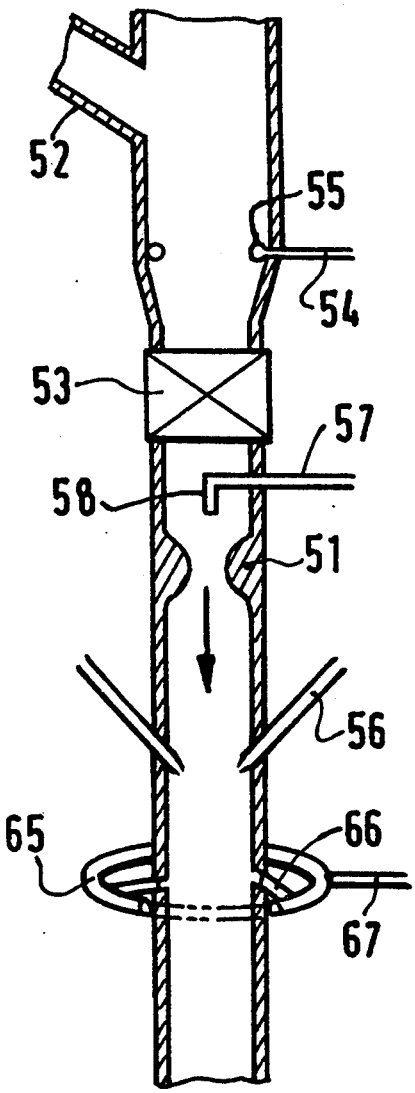
FIG. 6 is a partial diagrammatic view of a dilute-downflow catalytic cracking reactor equipped with a similar third preferred tangential embodiment of the homogenization apparatus of the invention.

Finally, FIG. 6 illustrates the use of a homogenization apparatus in accordance with the invention in a tubular reactor with dilute downflow of the catalyst particles.

In this embodiment, the regenerated catalyst particles are introduced into the upper part of the reactor 51 through the line 52 and flow by gravity. A valve 53 is provided for controlling the catalyst throughput. A diffuser 55, supplied with gas through the line 54, maintains the particles in a dense fluidized bed upstream of the valve 53. Downstream of that valve, the catalyst is maintained in a dilute fluidized phase by injection of a second gas into the reactor through the diffuser 58, supplied through the line 57.

The feedstock to be cracked is then introduced into the reactor 51 by means of atomizers 56, aimed in the direction of the stream of particles in the reactor and inclined relative to the axis thereof at an angle of from 30 to 60 degrees, for example.

Figure 5:
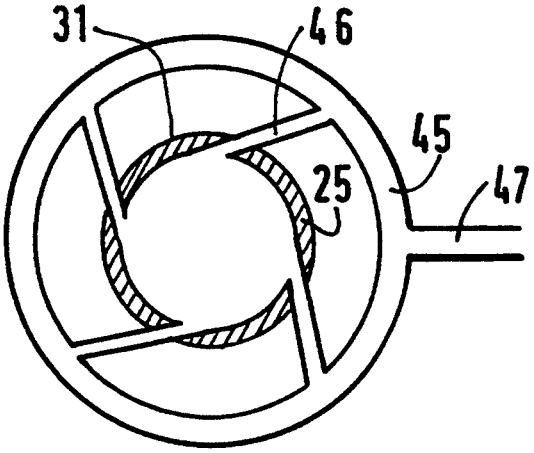
FIG. 5 is a sectional view of the tangential gaseous-fluid injection device used in the reactor of FIG. 4.

Directly downstream of these atomizers 56 there is provided a homogenization apparatus in accordance with the invention and of the same type as that shown in FIG. 5, that is, comprising injectors 66 (akin to injection tubes 46) disposed tangentially to the reactor 51 and connected to a distributor 65 (akin to distributor 45) that is supplied with pressurized gas through a line 67 (akin to line 47).

The invention may be further illustrated by the following non-limiting example, many apparent variations of which are possible without departing from the spirit thereof.

EXAMPLE

Two catalytic cracking tests were performed with the same hydrocarbon feedstock in a catalytic cracking unit of the general type of FIG. 1 of the accompanying drawings. One of these tests (Test 1) was run without the use of a homogenization apparatus in accordance with the invention. The other test (Test 2) was carried out with the use of the devices shown in FIGS. 3 and 4.

The feedstock treated was a vacuum distillate having the following characteristics:

Gravity (°API): 21
Sulfur (wt. %): 1.3
Basic nitrogen (ppm by weight): 730
Vanadium (ppm): 2
Nickel (ppm): 1
Conradson carbon (wt. %): 1.5

The operating conditions during the two tests were as shown in Table 1 which follows.

TABLE 1

| | Test 1 | Test 2 |
|---|---|---|
| Catalyst temperature upstream of point of injection (°C.) | 734 | 720 |
| Feedstock injection temperature (°C.) | 250 | 250 |
| Reactor outlet temperature (°C.) | 529 | 529 |
| Catalyst type | Zeolite USY | Zeolite USY |
| Throughput of fluid in gaseous state (t/h) | 0 | 2 |
| Fluid injected (wt. %), based on fluidized bed | 0 | 0.19 |
| Velocity of injection of gaseous fluid (m/s) | — | 40 |

The results of Tests 1 and 2 are presented in Table 2 which follows.

TABLE 2

| | Test 1 | Test 2 |
|---|---|---|
| Dry gases (wt. % of feedstock) | 4.65 | 4.35 |
| LPG (wt. %) | 16.07 | 16.38 |
| Gasoline (wt. %) | 45.82 | 46.90 |
| Light cutter stock (wt. %) | 15.82 | 15.42 |
| Slurry (wt. %) | 11.79 | 11.13 |
| Coke (wt. %) | 5.40 | 5.36 |
| Conversion at 220° C. (vol. %) | 72.39 | 73.45 |
| Yield, liquid hydrocarbons above $C_3$ | 77.71 | 78.70 |

As is apparent from this table, the conversion is improved (by more than 1 wt. %), as is the selectivity of the reaction. More gasoline is obtained, and less dry gas and catalyst slurry. Moreover, Table 1 shows an appreciable drop in catalyst temperature upstream of the point of feedstock injection, which translates into a reduction of the regenerator temperature by 14° C.

Having described in detail preferred embodiments of the present invention, it is to be understood that the invention defined by the appended claims is not to be limited by particular details set forth in the above description as many apparent variations thereof are possible without departing from the spirit or scope of the present invention.

What is claimed is:

1. A process for rendering substantially homogeneous a mixture of hot solid particles and hydrocarbon vapors being treated within a fluidized bed of a tubular reactor for cracking hydrocarbons; said reactor having a zone of injection where hydrocarbon feedstock is introduced into the reactor, a reaction zone where at least 75% of droplets of the feedstock are vaporized, and, a side wall having an interior surface; said process comprising injecting a fluid in the gaseous state into the reactor away from, one or more points on the interior surface of the side wall, directly downstream of the zone of injection, and in the reaction zone; wherein the fluid in the gaseous state is injected into the reactor within the bounds defined by a plane which makes an angle of from about 30 to about 150 degrees with the axis of the reactor and the injecting is effective to counteract backmixing and to counteract accumulation of particles in the vicinity of the side wall.

2. A process as defined in claim 1, wherein the fluid in the gaseous state is injected into the reactor annularly or helically at a plurality of points distributed substantially evenly over the interior surface of the reactor wall.

3. A process as defined in claim 2 wherein the fluid in the gaseous state is injected into the reactor substantially tangentially to the side wall of the reactor.

4. A process as defined in claim 3 wherein the fluid in the gaseous state is selected from the group consisting of hydrogen, nitrogen, argon, light hydrocarbons having from 1 to about 5 carbon atoms, vaporized gasoline and steam.

5. A process as defined in claim 4 wherein the fluid in the gaseous state is injected into the reactor at a rate representing from about 0.005 to about 1 percent by weight of the solid particles.

6. A process as defined in claim 4 wherein the fluid in the gaseous state is injected into the reactor at a velocity of from about 1 to about 100 meters/second.

7. A process as defined in claim 6 wherein the fluid in the gaseous state is injected into the reactor at a velocity of from about 20 to about 50 meters/second.

8. A process as defined in claim 2 wherein the fluid in the gaseous state is injected into the reactor substantially perpendicularly to the side wall of the reactor.

9. A process as defined in claim 1 wherein the fluid in the gaseous state is selected from the group consisting of hydrogen, nitrogen, argon, light hydrocarbons having from 1 to about 5 carbon atoms, vaporized gasoline, and steam.

10. A process as defined in claim 9 wherein the fluid in the gaseous state is injected into the reactor at a rate representing from about 0.005 to about 1 percent by weight of the solid particles.

11. A process as defined in claim 5 wherein the fluid in the gaseous state is injected into the reactor at a velocity of from about 1 to about 100 meters/second.

12. A process as defined in claim 5 wherein the fluid in the gaseous state is injected into the reactor at a velocity of from about 20 to about 50 meters/second.

13. A process for cracking hydrocarbons in an essentially upright tubular reactor having a dilute fluidized bed of hot solid particles, said reactor having a zone of injection where hydrocarbon feedstock is introduced into the reactor, a reaction zone where at least 75% of droplets of the feedstock are vaporized, and, a side wall having an interior surface, said process comprising:

feeding a stream of the hot solid particles to the reactor, imparting an upward or downward motion to the hot solid particles while said particles are in the reactor so as to maintain said particles in the fluidized bed, contacting at least one hydrocarbon feedstock with the hot solid particles by injecting said feedstock into the fluidized bed to thereby obtain a gaseous product, injecting a fluid in the gaseous state into the reactor away from, one or more points on the interior surface of the side wall, directly downstream of the zone of injection, and in the reaction zone to thereby render substantially homogeneous a mixture of the hot solid particles and hydrocarbon vapors being treated within the fluidized bed, and separating the gaseous product from the hot solid particles; wherein the fluid in the gaseous state is injected into the reactor within the bounds defined by a plane which makes an angle of from about 30 to about 150 degrees with the axis of the reactor and the injecting is effective to counteract backmixing and to counteract accumulation of particles in the vicinity of the side wall.

14. A process as defined in claim 13 wherein the reactor has an inlet for feeding the hot solid particles to the reactor; the feeding of the hot solid particles to the reactor is continuous; and after separating the gaseous product from the hot solid particles, the process further comprises recycling said particles to the inlet.

15. A process as defined in claim 14 wherein the process further comprises reactivating the particles prior to recycling said particles to the inlet.

* * * * *